US007686190B2

(12) United States Patent
Patrick

(10) Patent No.: US 7,686,190 B2
(45) Date of Patent: Mar. 30, 2010

(54) DISPENSING HEAD FOR A PRESSURISED CONTAINER RECEIVING A PRESSURISED FREE-FLOWING MEDIUM

(75) Inventor: Campbell Patrick, Bad Oldesloe (DE)

(73) Assignee: Lindal Ventil GmbH, Bad Oldesloe (DE)

( * ) Notice: Subject to any disclaimer, the term of this patent is extended or adjusted under 35 U.S.C. 154(b) by 403 days.

(21) Appl. No.: 11/833,609

(22) Filed: Aug. 3, 2007

(65) Prior Publication Data

US 2008/0017668 A1 Jan. 24, 2008

(30) Foreign Application Priority Data

Aug. 4, 2006 (DE) ..... 10 2006 036 517

(51) Int. Cl.
*B67B 5/00* (2006.01)

(52) U.S. Cl. ..... 222/153.11; 222/402.11; 222/402.13

(58) Field of Classification Search ..... 222/153.11–153.14, 402.11, 402.13, 402.15
See application file for complete search history.

(56) References Cited

U.S. PATENT DOCUMENTS 3,734,353 A 5/1973 McIlhenny
3,749,286 A 7/1973 Douglas

*Primary Examiner*—Kevin P Shaver
*Assistant Examiner*—Andrew P Bainbridge
(74) *Attorney, Agent, or Firm*—Vidas, Arrett & Steinkraus, P.A.

(57) ABSTRACT

Dispensing head made of plastics for a pressurised container receiving a pressurised free-flowing medium, comprising a cap which may be positioned onto the pressurised container, which comprises an actuating portion which may be moved relative to the cap, for a dispensing valve which is attached to the pressurised container and which is connected to a channel in the dispensing head and an applicator on the dispensing head which may be connected to the outlet of the channel, via which the medium is discharged, characterised in that inside the cap a movable locking portion is provided which, in a locked position, blocks an actuation of the actuating portion and the applicator is movably mounted relative to the dispensing head such that, with a movement in the direction of the dispensing head, it moves the locking portion into a release position, in which an actuation of the actuating portion and thus an actuation of the dispensing valve is permitted.

7 Claims, 2 Drawing Sheets

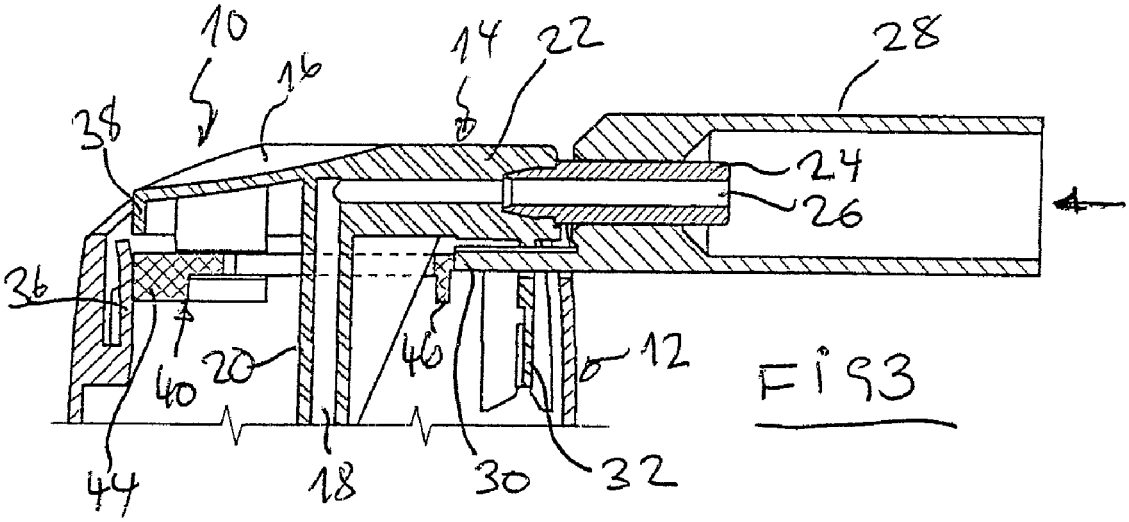
Fig 3
Fig 4
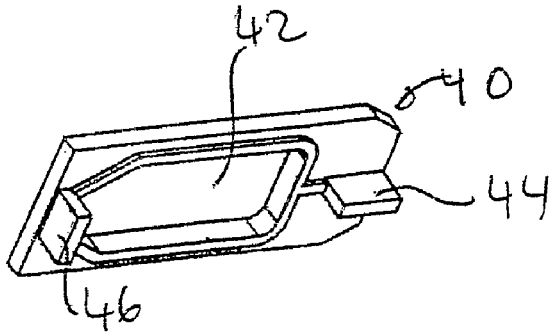

DISPENSING HEAD FOR A PRESSURISED CONTAINER RECEIVING A PRESSURISED FREE-FLOWING MEDIUM

CROSS-REFERENCE TO RELATED APPLICATIONS

Not applicable.

STATEMENT REGARDING FEDERALLY SPONSORED RESEARCH

Not applicable.

BACKGROUND OF THE INVENTION

Pressurised containers for dispensing liquid, gaseous or pasty or even powdery media are known in different variations. They are sealed by a valve which, when actuated, permits the discharge of the medium.

The propellant required for the discharge of the medium is, in turn, in gaseous or liquid form. It is further known to form such pressurised containers from sheet metal and to provide said pressurised containers with a cap, via which the medium is discharged. Such a cap may, for example, contain a spray nozzle. The cap is generally made of plastics material and comprises an actuating portion for actuating the dispensing valve. The actuating portion is either formed integrally with the cap and connected thereto via a film portion or is even a separate component.

The dispensing channel is connected to the dispensing valve and guided through the dispensing head. It is optionally a component of the cap and/or the actuating portion.

It is also known to receive a medical preparation in such pressurised containers in order to apply said preparation at suitable points, for example a so-called liquid plaster, a disinfection means or the like. Frequently, it is also important that the discharged fluid is applied on a predetermined limited surface. An inadvertent actuation of the actuating portion for dispensing the liquid on undesirable application points is intended to be avoided.

The object of the invention is, therefore, to provide a dispensing head made of plastics for a pressurised container receiving a pressurised free-flowing medium, in which an inadvertent actuation of the actuating portion may be prevented.

BRIEF SUMMARY OF THE INVENTION

In the dispensing head according to the invention, inside the cap a movable locking portion is provided which, in its locked position, blocks an actuation of the actuating portion The applicator attached to the dispensing head is movably mounted relative to the dispensing head such that, with a movement in the direction of the dispensing head, it moves the locking portion into a release position, when an actuation of the actuating portion and thus an actuation of the dispensing valve is permitted.

In the solution according to the invention, two separate actuating processes are required in order to dispense the medium from the pressurized container. One process consists in moving the applicator relative to the dispensing head. This may be carried out by the applicator being positioned and slightly pressed onto the surface onto which the medium is to be applied so that it moves towards the dispensing head. This movement moves the locking portion into the release position whereby, as a further process, an actuation of the actuating portion is permitted.

In one embodiment of the invention it is provided that the locking portion is formed integrally with the cap.

In order to achieve a relative motion of the applicator, according to one embodiment of the invention it is provided that on the dispensing end of the channel a tubular piece is connected to the dispensing head and on which the applicator is displaceably mounted, According to a further embodiment of the invention, the locking portion is arranged on the end opposing the applicator and a sliding element is displaceably mounted between the locking portion and the applicator, via which the movement of the applicator may be transmitted to the locking portion. The sliding element extends transversely to an axially aligned portion of the dispensing channel so that said portion of the dispensing channel extends through an opening of the sliding element.

Preferably the actuating portion, relative to the cap, is a separate component which is displaceably and/or tiltably mounted in the cap and actuates the dispensing valve when actuated. To this end, the actuating portion is provided with a stop portion which, in the locked position of the locking portion, cooperates therewith. The actuating portion preferably also contains the dispensing channel and stores the applicator, preferably via the already mentioned tubular piece. The applicator projects via a tongue into the cap and/or into the actuating portion in order to move the locking portion into the release position via the sliding element.

BRIEF DESCRIPTION OF THE SEVERAL VIEWS OF THE DRAWINGS

An embodiment of the invention is described in more detail hereinafter with reference to drawings, in which:

FIG. 3 shows the displacement of a locking portion into the release position via the applicator.

FIG. 4 shows a sliding element according to FIGS. 1 to 3 in perspective.

DETAILED DESCRIPTION OF THE INVENTION

Figure 1:
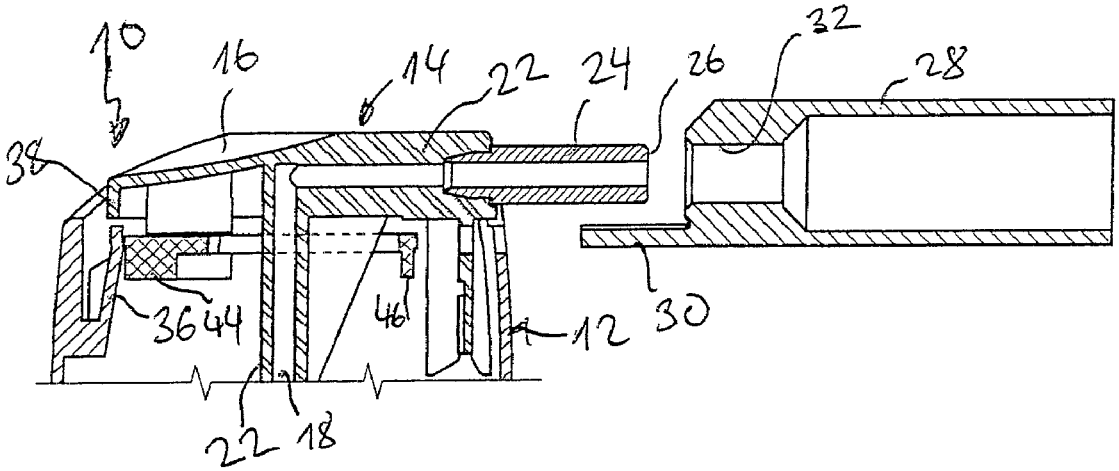
FIG. 1 shows in section a dispensing head according to the invention, shortly before attaching an applicator.
Figure 2:
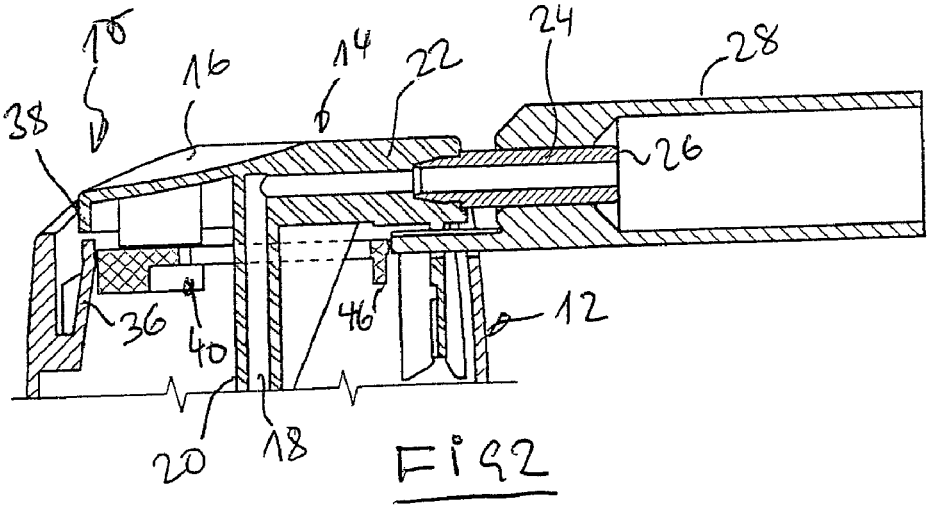
FIG. 2 shows a similar view to FIG. 1 after attaching the applicator.

While this invention may be embodied in many different forms, there are described in detail herein a specific preferred embodiment of the invention. This description is an exemplification of the principles of the invention and is not intended to limit the invention to the particular embodiment illustrated A dispensing head 10 is shown in FIGS. 1 to 3 in section. It comprises a cap 12 which is manufactured from a plastics material and is positioned on a pressurized container, not shown here, for a free-flowing medium. The pressurized container is provided in the known manner with a dispensing valve, which is also not shown here, The cap 12 is open at the top and receives an actuating portion 14, which in the left region shown in FIGS. 1 to 3, comprises a trough-like recess 16, via which the actuating portion 14 is moved downwards by finger pressure. The mounting of the actuating portion 14 in the cap 12 is not shown in detail. Such a principle is known per se.

The actuating portion 14 comprises a dispensing channel 18 which extends in a vertical tubular channel portion 20 and a second channel portion 22 extending at right angles thereto.

The horizontal channel portion 22 comprises a portion which is conically widened towards the free end, into which a tubular piece 24 is clampingly inserted, The tubular piece 24 is of complementary conical shape on the inserted end. The tubular piece 24 lengthens the dispensing channel 18 as far as one free end 26.

A tubular adaptor 28 is displaceably mounted on the tubular piece 24 which on the end facing the actuating portion 14 comprises an actuating tongue 30. The actuating tongue extends through a slot opening in the cap 12 and through a slot-like opening in a downwardly projecting portion 32 of the actuating portion 14. In FIG. 1 the applicator 28 is still located at a distance from the dispensing head 10. In FIG. 2 it is shown how the applicator 28 is pushed onto the tubular piece 24 with a cylindrical bore portion 32 onto the tubular piece 24.

The vertical channel portion 20 is connected to the dispensing valve, not shown, and/or receives a so-called stem of the dispensing valve, whereby with a downward actuation of the actuating portion 14 in FIGS. 1 to 3 the dispensing valve is opened.

As may further be seen in FIGS. 1 to 3, inside the cap 12 on the end opposing the tubular piece 24 an upwardly projecting spring tongue 36 is formed. In the region of the recess 16 the actuating portion 14 comprises a downwardly projecting edge 38, which cooperates with the upwardly projecting free end of the spring tongue 36, when an attempt is made to move the actuating portion 14 downwards. In this position, the spring tongue 36 is in its locked position.

A sliding element 40 is arranged between the spring tongue 36 and the actuating tongue 30 of the applicator 28. It is displaceably mounted in the actuating portion 14 which is not shown in detail.

If the applicator, as shown in FIG. 3, is moved by a corresponding pressure on its front end in the direction of the dispensing head 10, the sliding element 40 is displaced via the actuating tongue 30 and deforms the spring tongue 36, whereby said spring tongue moves into a release position, in which it is possible to press the actuating portion 14 downwards, in order to actuate the dispensing valve.

The sliding element 40 is shown separately in FIG. 4. It is plate-shaped with an elongated central opening 42. The vertical channel portion 20 extends through this opening. A first shoulder 44 of the sliding element 40 bears against the spring tongue 36. A second shoulder 46 extending in the same direction bears against the actuating tongue 30 of the applicator 28.

Thus it may be seen that by displacing the applicator 28 out of the position according to FIG. 2 into the position according to FIG. 3, an unlocking of the actuating portion 14 is achieved, so that said actuating portion is able to open the dispensing valve, so that the medium to be dispensed may flow via the channel 18 and the applicator 28.

The above disclosure is intended to be illustrative and not exhaustive, This description will suggest many variations and alternatives to one of ordinary skill in this art, All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

This completes the description of the preferred and alternate embodiments of the invention. Those skilled in the art may recognize other equivalents to the specific embodiment described herein which equivalents are intended to be encompassed by the claims attached hereto.

What is claimed is:

1. Dispensing head made of plastics for a pressurised container receiving a pressurised free-flowing medium, comprising a cap which may be positioned onto the pressurised container, which comprises an actuating portion which may be moved relative to the cap, for a dispensing valve which is attached to the pressurised container and which is connected to a channel in the dispensing head and an applicator on the dispensing head which may be connected to the outlet of the channel, via which the medium is discharged, characterised in that inside the cap (12) a movable locking portion (36) is provided which, in a locked position, blocks an actuation of the actuating portion (14) and the applicator (28) is movably mounted relative to the dispensing head (10) such that, with a movement in the direction of the dispensing head (10), it moves the locking portion (36) into a release position, in which an actuation of the actuating portion (14) and thus an actuation of the dispensing valve is permitted.

2. Dispensing head according to claim 1, characterised in that a flexible locking portion (36) is formed integrally with the cap (12).

3. Dispensing head according to claim 1, characterised in that on the dispensing end of the channel (18) a tubular piece (24) is connected to the dispensing head (10) and on which the applicator (28) is displaceably mounted.

4. Dispensing head according to claim 1, characterised in that the locking portion (36) is arranged on the end opposing the applicator (28) and a sliding element (40) is displaceably mounted between the locking portion (36) and the applicator (28), via which a movement of the applicator (28) is transmitted to the locking portion (36).

5. Dispensing head according to claim 4, characterised in that the sliding element (40) comprises an elongate opening (42) through which a portion (20) of the channel (18) extends.

6. Dispensing head according to claim 4, characterised in that the applicator (28) comprises an actuating tongue (30) which projects via a slot in the cap (12) into the dispensing head.

7. Dispensing head according to claim 1, characterised in that the actuating portion (14) contains the channel (18) and engages the applicator (28).

* * * * *